US005344151A

United States Patent [19]

Anderson et al.

[11] Patent Number: 5,344,151

[45] Date of Patent: Sep. 6, 1994

[54] GOLF PUTTER HEAD

[76] Inventors: Bartley D. Anderson, 3925 Pine Meadow Rd., New Albany, Ohio 43054; Robert V. Carney, Sr., 3962 Courter Rd., Pataskala, Ohio 43062

[21] Appl. No.: 107,291

[22] Filed: Aug. 11, 1993

[51] Int. Cl.[5] ..... A63B 53/08

[52] U.S. Cl. ..... 273/171; 273/164.1

[58] Field of Search ..... 273/167 R–177 A, 273/77 R, 162 R, 164.1

[56] References Cited

U.S. PATENT DOCUMENTS

| | | | |
|---|---|---|---|
| 1,133,129 | 3/1915 | Govan | 273/171 |
| 1,167,387 | 1/1916 | Daniel | 273/171 |
| 1,840,924 | 1/1932 | Tucker | 273/171 |
| 2,056,335 | 10/1936 | Wettlaufer | 273/171 |
| 3,606,327 | 9/1971 | Gorman | 273/171 X |
| 3,979,123 | 9/1976 | Belmont | 273/171 |
| 4,052,075 | 10/1977 | Daly | 273/171 |
| 4,325,553 | 4/1982 | Taylor | 273/171 X |
| 4,895,371 | 1/1990 | Bushner | 273/171 X |
| 5,046,740 | 9/1991 | D'Eath | 273/171 X |

*Primary Examiner*—Vincent Millin
*Assistant Examiner*—Sebastiano Passaniti

[57] ABSTRACT

A golf putter head is disclosed which utilizes a cylindrical weight receptacle (18) centrally located and perpendicular to the rear of the location on the striking surface (22) where the golf ball is intended to be struck. The weight receptacle circumscribes a port (16) which accepts any one of a variety of notched, graduated weights (17) which are secured by set screws (24) and (32) that tighten through the weight receptacle into the weight notch (28) using a hexkey. Horizontal stabilizers (14) and (26) connect the sides of the weight receptacle to the rear heel-toe axis of the blade (12) thus embodying the weight receptacle into the general putter head configuration.

1 Claim, 2 Drawing Sheets

GOLF PUTTER HEAD

BACKGROUND OF THE INVENTION

This invention pertains to a golf putter head which has an adjustable, centered weighting system to assist the golfer in achieving greater effectiveness in his putting.

It has been our observation that the putt which has the greatest chance of holing out is the one that has enough momentum to propel the ball from twelve to eighteen inches past the cup. A putt struck in this manner will reduce the effect of spike marks, poorly repaired ball marks and other irregularities that tend to deflect the ball from its intended line. We have also observed that most putts are missed because of distance rather than direction.

Several patents have issued endeavoring to provide putter head designs which accomplish the general objective of consistently propelling the ball to the back of the hole where the back lip of the cup will cause the ball to drop in, some of which are as follows: U.S. Design Pat. No. D182,485, U.S. Pat. No. 690,940, U.S. Pat. No. 1,537,320, U.S. Pat. No. 2,957,696, U.S. Pat. No. 3,758,115, U.S. Pat. No. 3,888,484, U.S. Pat. No. 4,008,896, U.S. Pat. No. 4,138,117, U.S. Pat. No. 4,222,566, U.S. Pat. No. 4,253,667, U.S. Pat. No. 4,688,798, U.S. Pat No. 4,714,252, U.S. Pat. No. 5,046,740.

Originally, most putter heads were designed to the same configuration as an iron club but with less loft. Technical improvement took a leap forward with the introduction of heel-toe weighted putter heads that were designed to correct for direction on putts struck off center. The flaw in this design was that most accomplished golfers were capable of striking the putt on center and therefor rendered this configuration novel but not of any significant advantage.

The prior art cited above discloses efforts to center the weight behind the ball but seems to overlook the possibility of adjustability which, under certain conditions, is permitted by the United States Golf Association.

SUMMARY OF THE INVENTION

We have conceived of an improved golf putter head wherein a generally isosceles-trapezoid shaped head has a longitudinally-extending port in the body portion thereof disposed perpendicular to the blade and in alignment with the direction of putting. The port accepts any one of several notched, cylindrical weights which graduate in length and mass. The weights may be interchanged to adjust to prevailing green conditions or a persistent aggressive or tentative stroke that leaves the putt far past or short of the cup respectively. The various features of this invention were designed to conform to the following rules of golf, as stated by the United States Golf Association:

4-1a General

Adjustability—Exception for Putters

Clubs other than putters shall not be designed to be adjustable except for weight.

Some other forms of adjustability are permitted in the design of a putter, provided that:

(i) the adjustment can not be readily made;

(ii) all adjustable parts are firmly fixed and there is no reasonable liklihood of them working loose during a round; and (iii) all configurations of adjustment conform with the rules.

The disqualification penalty for purposely changing the playing characteristics of a club during a round (Rule 4-2) applies to all clubs, including a putter.

Accordingly, several objects and advantages of our invention are as follows:

Although the cylindrical weight receptacle is embodied in the general head configuration, its top half can be easily distinguished and assists in aiming the ball on the intended line. The cylindrical weight receptacle is of sufficient diameter to instill confidence that the ball can be squarely struck.

Because of unique weight distribution and design configuration, the putter head, when combined with shaft and grip, will tend to rest in a slight but noticeable open position when addressing the ball, thus encouraging conscious squaring of the club to the intended target line.

Weights can be changed conveniently but still conform to U.S.G.A. rule 4-1a(i). The rule is satisfied as adjustments can not be made using a coin, divot tool, golf tee, etc. A hexkey must be used.

Employing a straight hosel allows an uninterrupted view of the top-line of the putter blade when in the address position.

The selection of weights provided allow the golfer to accurately mimic a very light or very heavy putter also the variety of putters whose weights fall between the two extremes.

Figure 1:
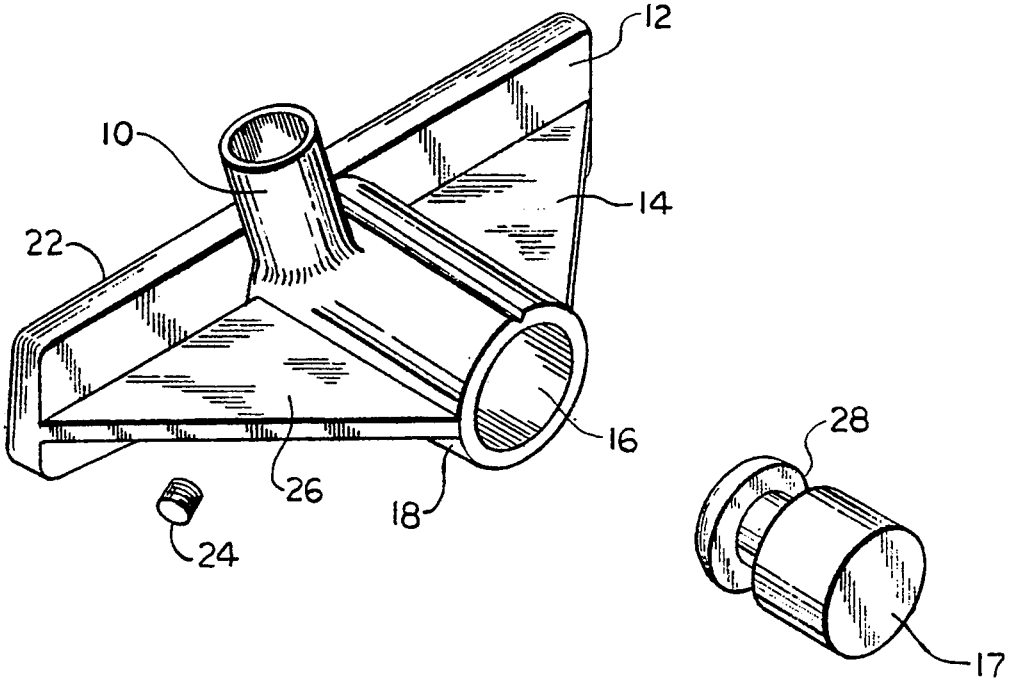
FIG. 1 is a perspective view of the putter head embodying our invention.
Figure 2:
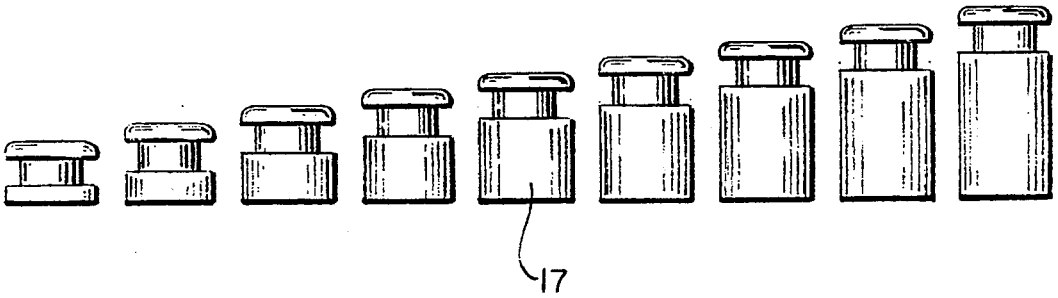
FIG. 2 is a side view of a selection of the graduated weights.
Figure 3:
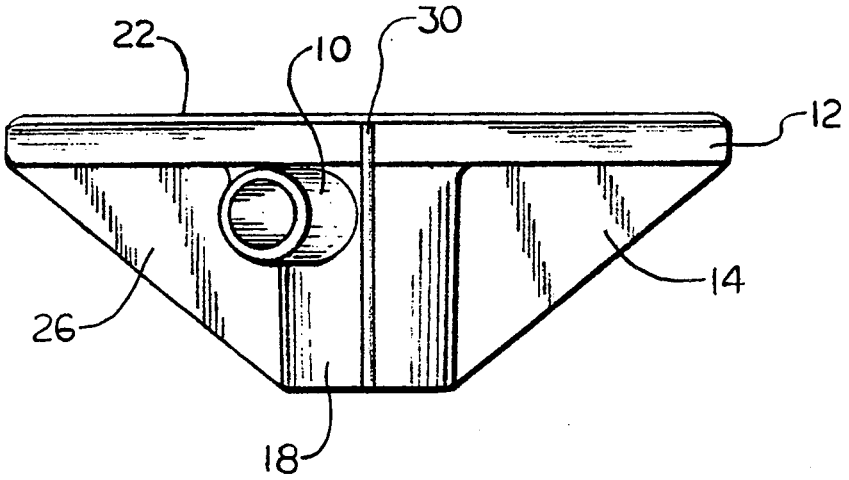
FIG. 3 is a top plain view.
Figure 4:
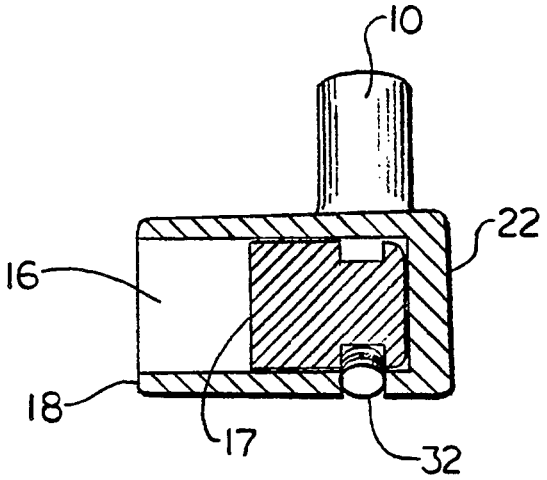
FIG. 4 is a sectional view, as seen from the toe side, with one weight inserted and secured.
Figure 5:
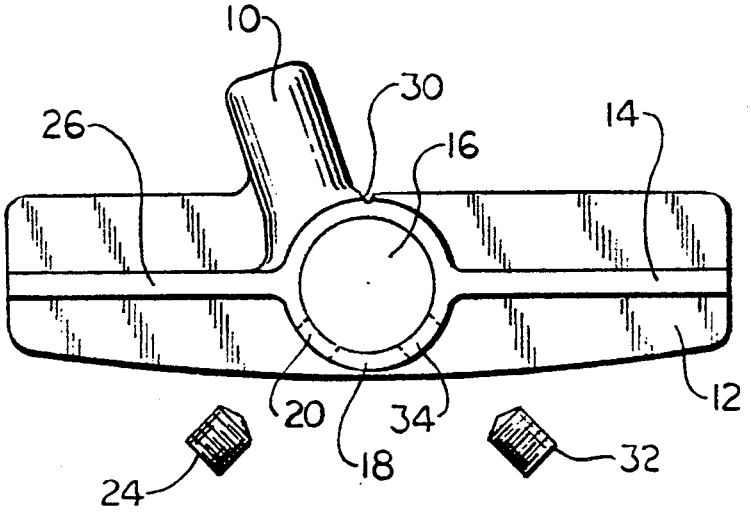
FIG. 5 is a rear view showing opposing set screws.

| REFERENCE NUMERALS IN THE DRAWINGS |
|---|
| 10 hosel |
| 12 blade |
| 14 right horizontal stabilizer |
| 16 port |
| 17 weight |
| 18 weight receptacle |
| 20 left set screw hole |
| 22 striking surface |
| 24 left set screw |
| 26 left horizontal stabilizer |
| 28 weight notch |
| 30 aiming notch |
| 32 right set screw |
| 34 right set screw hole |

DESCRIPTION OF PREFERRED EMBODIMENT

A golf putter head embodying our invention comprises an investment cast 316 stainless steel body consisting of a blade 12 with a striking surface 22. To the rear of the blade is a centered and longitudinally-extending port 16 and weight receptacle 18 which is situated perpendicular to the blade and is in alignment with the direction of putting.

The port accepts any one of a set of graduated brass weights 17. The selected weight is secured into the port by employing two opposing set screws 24 and 32 which tighten through threaded holes 20 and 34 into the weight notch 28 using a hexkey.

The weight receptacle is embodied into the general head configuration by employing left and right horizontal stabilizers 26 and 14 which are molded as an integral part of the putter head and connect the sides of the weight receptacle to the rear toe and heel axis of the blade. The weight receptacle displays an aiming notch 30 which is situated on the top thereof and is aligned at a 90 degree angle to the blade.

The hosel 10 projects upward from the heel side of the weight receptacle and accepts a gripped shaft at an angle that is comfortable for addressing the ball.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A golf putter head comprising in combination:

a. a putter blade having a striking surface, a rear and a center;

b. a hosel for accepting a gripped shaft;

c. a weight receptacle having a plurality of screw holes and positioned at the longitudinal center of said putter head and positioned perpendicular to a plane containing the rear of said putter blade;

d. a plurality of set screws;

e. a variety of graduated weights each notched for allowing said notch to align with said set screws when said weight is properly introduced into said weight receptacle;

f. said weight receptacle being configured for accepting any one of said variety of graduated, notched weights which are secured into said weight receptacle using said set screws which tighten through said screw holes of said weight receptacle into said notch of said one weight, and g. a plurality of horizontally positioned stabilizers which are affixed to both said weight receptacle and said rear of said putter blade for enabling said weight receptacle to be embodied into the general configuration of said putter head.

* * * * *